US012635743B2

(12) United States Patent
Prushiek

(10) Patent No.: US 12,635,743 B2
(45) Date of Patent: May 26, 2026

(54) PADDED GARMENT

(71) Applicant: Kathryn Marie Prushiek, Oconomowoc, WI (US)

(72) Inventor: Kathryn Marie Prushiek, Oconomowoc, WI (US)

( * ) Notice: Subject to any disclaimer, the term of this patent is extended or adjusted under 35 U.S.C. 154(b) by 0 days.

(21) Appl. No.: 18/982,779

(22) Filed: Dec. 16, 2024

(65) Prior Publication Data

US 2025/0113881 A1 Apr. 10, 2025

Related U.S. Application Data

(63) Continuation-in-part of application No. 18/501,881, filed on Nov. 3, 2023, now abandoned.

(60) Provisional application No. 63/422,575, filed on Nov. 4, 2022.

(51) Int. Cl.

| | |
|---|---|
| ***A41D 1/18*** | (2006.01) |
| ***A41B 9/06*** | (2006.01) |
| ***A47D 13/02*** | (2006.01) |
| *A41D 27/13* | (2006.01) |

(52) U.S. Cl.

CPC ..... *A41D 1/18* (2013.01); *A41B 9/06* (2013.01); *A41D 27/13* (2013.01); *A47D 13/025* (2013.01)

(58) Field of Classification Search

CPC . A41D 1/18; A41D 1/21; A41D 27/13; A41B 19/06; A41B 9/06; A47D 13/025

USPC ..... 2/455, 76, 69.5

See application file for complete search history.

(56) References Cited

U.S. PATENT DOCUMENTS

| | | | | |
|---|---|---|---|---|
| 3,421,514 | A * | 1/1969 | Friedlander | A41B 9/16 450/86 |
| 6,183,339 | B1 * | 2/2001 | Thompson | A41B 9/06 450/1 |
| 11,445,768 | B1 * | 9/2022 | Dehlsen | A41C 3/0028 |
| 2008/0052802 | A1 * | 3/2008 | Bryan | A41B 9/06 2/113 |
| 2008/0086791 | A1 * | 4/2008 | Kirkwood Samuel | A41B 9/06 2/54 |
| 2009/0265831 | A1 * | 10/2009 | Hendrickson | A41C 3/08 2/104 |
| 2014/0284362 | A1 * | 9/2014 | Halverstadt | A47D 13/025 224/159 |

* cited by examiner

*Primary Examiner* — Alissa L Hoey
*Assistant Examiner* — Akwokwo Olabisi Redhead

(57) ABSTRACT

A padded garment includes a garment, a first fabric layer, a second fabric layer, a first interstitial binding, and a second interstitial binding. Further, the garment includes a torso portion. Further, the first fabric layer is disposed in an interior of the garment. Further, the second fabric layer is disposed in the interior. Further, the first interstitial binding includes a first stitching. Further, the second interstitial binding includes a second stitching. Further, at least one first portion of a second fabric layer periphery of the second fabric layer is engaged to an inner surface of the garment using the second interstitial binding. Further, at least one first portion of a first fabric layer periphery of the first fabric layer is engaged to at least a portion of at least one second portion of the second fabric layer periphery of the second fabric layer using the first interstitial binding.

17 Claims, 14 Drawing Sheets

PADDED GARMENT

FIELD OF THE INVENTION

Generally, the present disclosure relates to the field of apparel. More specifically, the present disclosure relates to a padded garment.

BACKGROUND OF THE INVENTION

Bras and other undergarments can often be uncomfortable to wear for extended periods of time. However, going without such items can sometimes lead to embarrassing visibility through clothing, such as shirts and other garments. There thus exists a need for a comfortable garment capable of preventing visibility through the torso area without requiring the user to wear a bra or other undergarments.

Therefore, there is a need for a padded garment that may overcome one or more of the above-mentioned problems and/or limitations.

SUMMARY OF THE INVENTION

This summary is provided to introduce a selection of concepts in a simplified form, that are further described below in the Detailed Description. This summary is not intended to identify key features or essential features of the claimed subject matter. Nor is this summary intended to be used to limit the claimed subject matter's scope.

Disclosed herein is a padded garment, in accordance with some embodiments. Accordingly, the padded garment may include a garment, a first fabric layer, a second fabric layer, a first interstitial binding, and a second interstitial binding. Further, the garment may include a torso portion. Further, the first fabric layer may be disposed in an interior of the garment. Further, the second fabric layer may be disposed in the interior of the garment. Further, the first interstitial binding may include a first stitching. Further, the second interstitial binding may include a second stitching. Further, at least one first portion of a second fabric layer periphery of the second fabric layer may be engaged to an inner surface of the garment using the second interstitial binding. Further, at least one first portion of a first fabric layer periphery of the first fabric layer may be engaged to at least a portion of at least one second portion of the second fabric layer periphery of the second fabric layer using the first interstitial binding.

Further disclosed herein is a padded garment, in accordance with some embodiments. Accordingly, the padded garment may include a garment, a first fabric layer, a second fabric layer, a first interstitial binding, and a second interstitial binding. Further, the garment may include a torso portion. Further, the first fabric layer may be disposed in an interior of the garment. Further, the second fabric layer may be disposed in the interior of the garment. Further, the first interstitial binding may include a first stitching. Further, the second interstitial binding may include a second stitching. Further, at least one first portion of a second fabric layer periphery of the second fabric layer may be engaged to an inner surface of the garment using the second interstitial binding. Further, at least one first portion of a first fabric layer periphery of the first fabric layer may be engaged to at least a portion of at least one second portion of the second fabric layer periphery of the second fabric layer using the first interstitial binding. Further, the at least one second portion of the second fabric layer periphery of the second fabric layer may be unengaged from the garment. Further, at least one second portion of the first fabric layer periphery may be unengaged from at least the portion of the at least one second portion of the second fabric layer periphery, and the garment. Further, the at least one second portion of the second fabric layer periphery and the at least one second portion of the first fabric layer periphery may be free from the garment.

Further disclosed herein is a padded garment, in accordance with some embodiments. Accordingly, the padded garment may include a garment, a first fabric layer, a second fabric layer, a first interstitial binding, and a second interstitial binding. Further, the garment may include a torso portion. Further, the first fabric layer may be disposed in an interior of the garment. Further, the second fabric layer may be disposed in the interior of the garment. Further, the first interstitial binding may include a first stitching. Further, the second interstitial binding may include a second stitching. Further, at least one first portion of a second fabric layer periphery of the second fabric layer may be engaged to an inner surface of the garment using the second interstitial binding. Further, at least one first portion of a first fabric layer periphery of the first fabric layer may be engaged to at least a portion of at least one second portion of the second fabric layer periphery of the second fabric layer using the first interstitial binding. Further, the at least one second portion of the second fabric layer periphery of the second fabric layer may be unengaged from the garment. Further, at least one second portion of the first fabric layer periphery may be unengaged from at least the portion of the at least one second portion of the second fabric layer periphery, and the garment. Further, the at least one second portion of the second fabric layer periphery and the at least one second portion of the first fabric layer periphery may be free from the garment. Further, the first fabric layer may be comprised of at least one first material. Further, the second fabric layer may be comprised of at least one second material. Further, the at least one first material may be softer than the at least one second material.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and subcombinations described in the detailed description.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the applicants. The applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure.

DETAILED DESCRIPTION OF THE INVENTION

Figure 1:
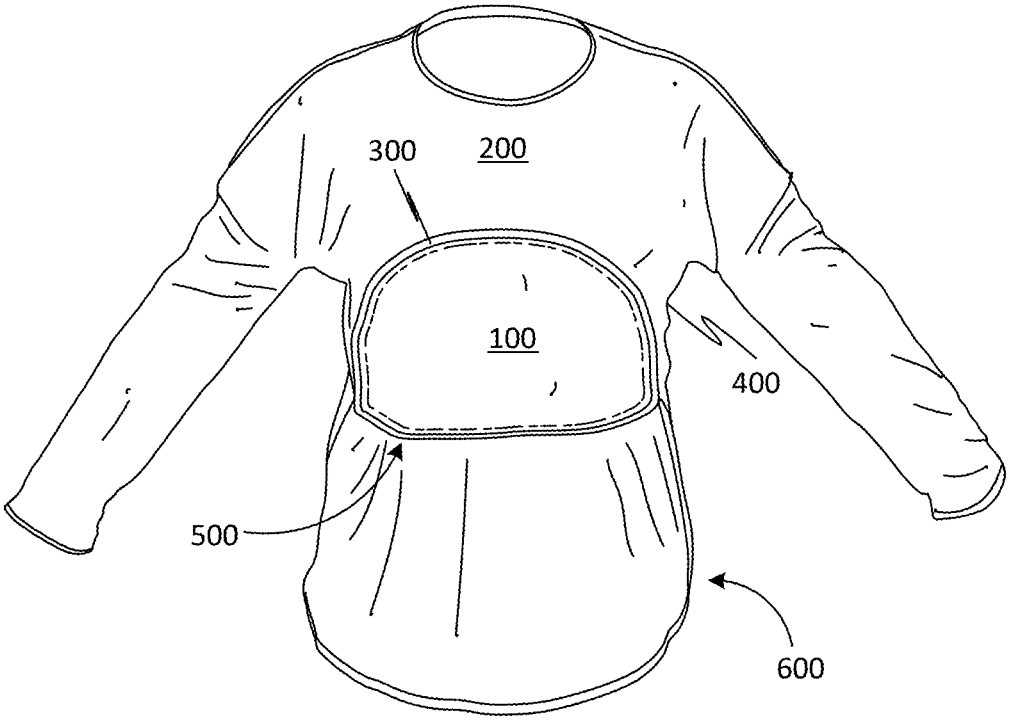
FIG. 1 is a front perspective view of a padded garment 600 showing an inside-out view of the garment 600.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim limitation found herein and/or issuing here from that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the claims found herein and/or issuing here from. The present disclosure contains headers. It should be understood that these headers are used as references and are not to be construed as limiting upon the subjected matter disclosed under the header.

The present disclosure includes many aspects and features. Moreover, while many aspects and features relate to, and are described in the context of a padded garment, embodiments of the present disclosure are not limited to use only in this context.

Overview

The present disclosure describes a padded garment.

Further, the padded garment includes a garment having an additional unnoticeable extra layer of fabric (such as a first fabric layer and a second fabric layer) to obscure the chest of the wearer to prevent visibility through the torso area without requiring the user to wear a bra or other undergarment. The padded garment removes the need for the user to wear a bra and provides extra comfort. The extra layer of fabric may be thick enough to prevent visibility through the shirt and maybe stitched into or otherwise engaged to an existing garment. In some embodiments, two fabric layers may be used: a first, softer fabric layer that covers the chest of the user, and a second fabric layer that covers the broader torso of the user and assists in attaching the fabric layers to the shirt. In the ideal embodiment, the bottom of the first fabric layer remains unengaged, such that an opening is created between the first fabric layer and the garment. This opening helps the fabric lay flat, especially during washing and drying and helps to avoid the fabric getting bunched up during use.

In the ideal embodiment, the second fabric layer is engaged to the torso of the garment along any lines of existing stitching of the garment, or by being positioned such the stitching is otherwise unnoticeable from the exterior of the garment. This assists the invention in remaining unnoticeable from an external observer, as only the existing lines of stitching on the fabric are visible.

Further, the present disclosure relates generally to the construction of a padded garment, specifically padded shirts and garments for the torso of the user.

Further, the present disclosure describes a padded garment having padded chest area. A first fabric layer is fastened on the interior of the garment, the first fabric layer being fastened to a second fabric layer using a first interstitial binding to provide additional padding on the chest of the garment. The second fabric layer is fastened to the garment using a second interstitial binding. The second interstitial binding may align with the existing stitching on the garment, such that the second interstitial binding is not visible or is masked by the existing stitching and fasteners of the garment. The additional first and second fabric layers are thick enough to prevent visibility through the garment.

Further, Referring now to FIGS. 1-5, the present invention is a padded garment 600 comprising a garment 600, a first fabric layer 100, a second fabric layer 200, a first interstitial binding 300, a second interstitial binding 400, and an opening 500.

The garment 600 may comprise any garment 600 well-known in the art. For example, the garment 600 may be a shirt, jacket, sweatshirt, pants, socks, headpiece, or any other garment 600 that is well-known in the art. In the ideal embodiment, however, the garment 600 comprises any garment 600 having a torso portion, ideally comprising a shirt.

Figure 4:
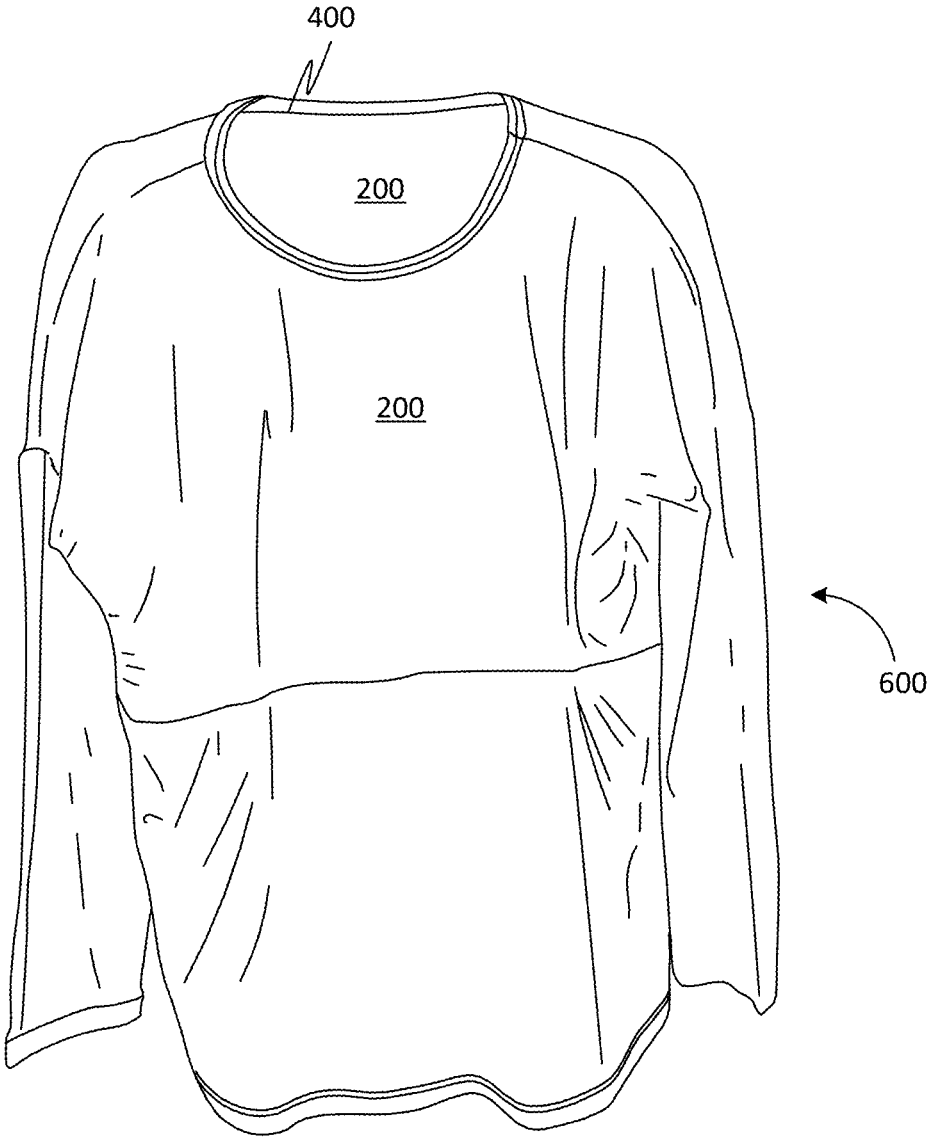
FIG. 4 is a front perspective view of the padded garment 600, showing the exterior of the garment 600.
Figure 5:
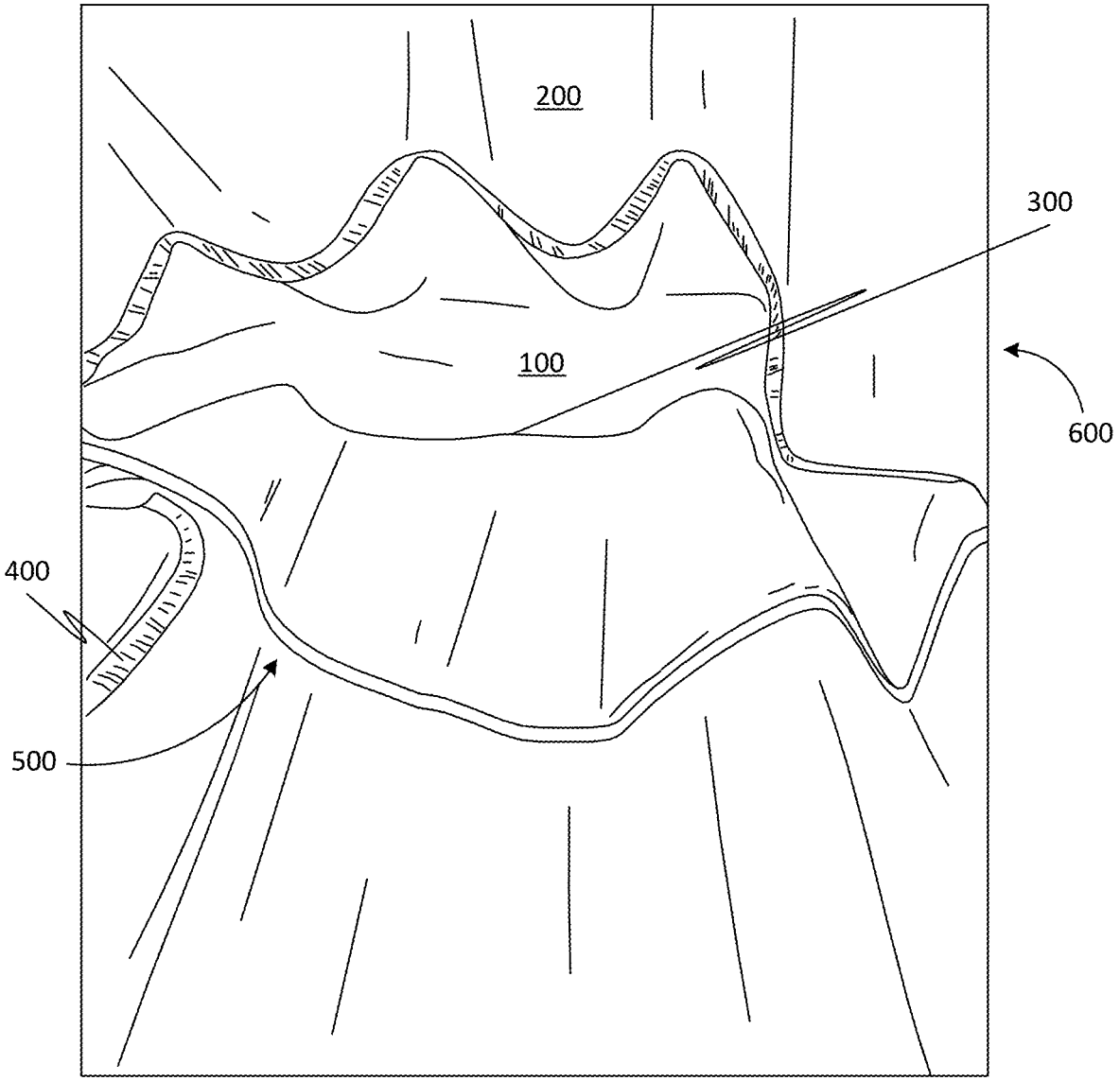
FIG. 5 is a bottom view of the interior of the garment 600, showing detailed location of an embodiment of the opening 500, first interstitial binding 300, and second interstitial binding 400.

The first fabric layer 100 may comprise any fabric well-known in the art, such as a fleece-like material, cotton, polyester, or any other fabric. The first fabric layer 100 is ideally comprised of a softer material than the second fabric layer 200 or may comprise a softer side of the same fabric as the first fabric layer 100 to avoid irritation of the wearer's skin and to improve the comfort of the garment 600. In some embodiments, the first fabric layer 100 may comprise a softer side facing the skin of the wearer, and a coarser side facing away from the skin of the wearer. In some embodiments, the first fabric layer 100 and second fabric layer 200 may be of identical softness. The first fabric layer 100 is ideally comprised of a material that is thick enough to prevent any visibility through the garment 600. In the ideal embodiment, the first fabric layer 100 may comprise a roughly half-elliptical shape as shown in FIG. 1, such that the first fabric layer 100 may cover roughly the shape of the wearer's chest area. As shown in FIG. 1, in the ideal embodiment, the first fabric layer may comprise a left arc running up the left side of the chest, a top arc running across the chest, a right arc running up the right side of the chest of the garment 600, and a straight bottom running across the garment from either side of the chest. Other shapes, configurations, and positions of the first fabric layer 100 are contemplated. As shown in FIG. 4, the first interstitial binding 300 and first fabric layer 100 are not visible through the exterior of the garment 600. The second fabric layer 200 and second interstitial binding 400 may only be visible at the neckline on the interior of the garment 600, but will not be visible when the garment 600 is worn against the skin of the wearer.

The second fabric layer 200 may comprise any fabric well-known in the art, such as a fleece-like material, cotton, polyester, or any other fabric. The second fabric layer 200 is ideally shaped to conform to the torso portion of the garment 600, as shown in FIGS. 1-5. The second fabric layer 200 provides additional padding for the wearer, and assists in connecting the first and second fabric layer 200 to the garment 600. The second fabric layer 200 is further ideally shaped so that the edges of the second fabric layer 200 conform to the stitching or seams on the garment 600, helping the garment 600 appear as a typical, unpadded garment 600 by an external observer.

The first interstitial binding 300 engages the first fabric layer 100 to the second fabric layer 200. The first interstitial binding 300 may comprise any fastening means well-known in the art, especially those adapted for securing fabric or clothing together. For example, the first interstitial binding 300 may comprise a plurality of stitches, a thermal weldment, an adhesive, a mechanical fastener, or any other fastening means that is well-known in the art. The first interstitial binding 300 is ideally positioned along the sides and top of the first fabric layer 100, securing the first fabric layer 100 to the second fabric layer 200, as shown in FIG. 1. In some embodiments, the first interstitial binding 300 may instead directly connect the first fabric layer 100 to the garment 600, and may further be aligned with the existing stitching or seams on the garment 600 to help the garment 600 appear as a typical, unpadded garment 600 by an external observer. In some embodiments, the first interstitial binding 300 may be detachably attachable. As shown in FIG. 1, in the ideal embodiment, the first interstitial binding 300 may comprise a left arc running up the left side of the chest, a top arc running across the chest, and a right arc running up the right side of the chest of the garment 600. Though the ideal embodiment is shown in the drawings, other shapes and configurations of the first interstitial binding 300 and shape of the first fabric layer 100 are contemplated.

Figure 2:
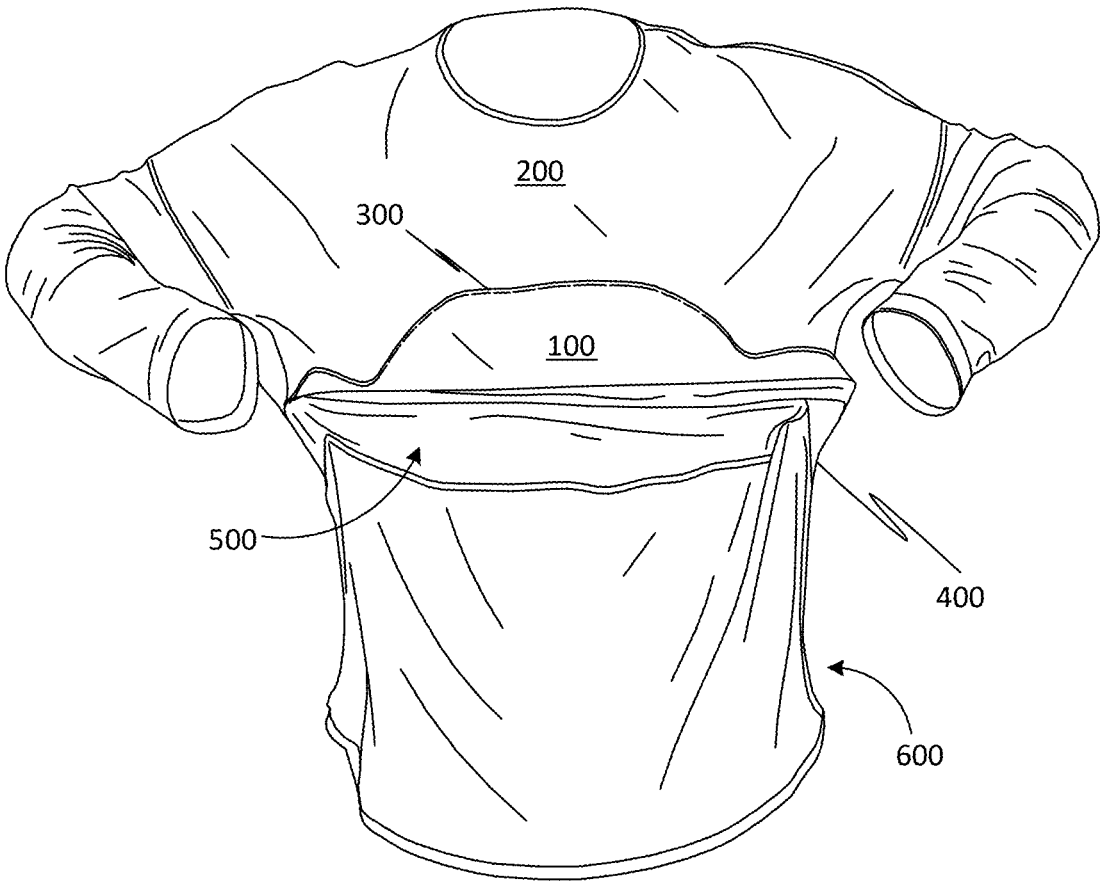
FIG. 2 is a front perspective view of the padded garment 600, showing an inside-out view of garment 600 with the first fabric layer 100 being lifted to show the opening.
Figure 3:
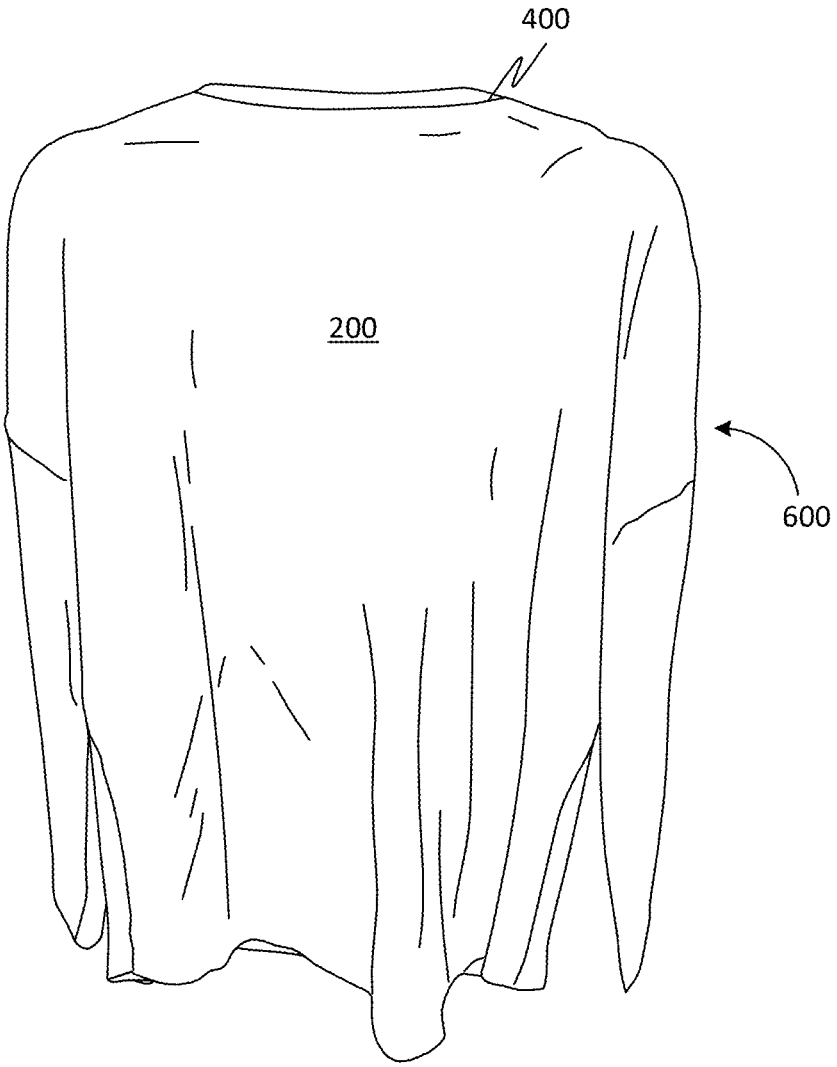
FIG. 3 is a back perspective view of the padded garment 600, showing an inside-out view of garment 600.

In the ideal embodiment, the first interstitial binding 300 runs only along the sides and top of the first fabric layer 100, leaving the bottom of the first fabric layer 100 unsecured to create an opening 500, as shown in FIGS. 1-3. The opening 500 is ideally positioned along the bottom of the first fabric layer 100, though other configurations of the first interstitial binding 300 to create opening 500 in different positions are contemplated. The opening 500 serves to help the fabric lay flat during washing and drying, assisting the fabric in avoiding unsightly bunching during care and during use.

The second interstitial binding 400 engages the second fabric layer 200 to the garment 600. The second interstitial binding 400 may comprise any fastening means well-known in the art, especially those adapted for securing fabric or clothing together. For example, the second interstitial binding 400 may comprise stitching, a thermal weldment, an adhesive, a mechanical fastener, or any other fastening means that is well-known in the art. The second interstitial binding 400 is ideally positioned along any existing seams or stitching of the garment 600 in order to hide the additional stitching and fabric from an external observer when the garment 600 is worn. As shown in, for example, FIG. 1, the second interstitial binding 400 may be positioned along underarm seams and neckline seams of the garment 600 to assist the second interstitial binding 400 in blending in with the existing bindings, fastenings, and stitching of the garment 600.

Figure 6:
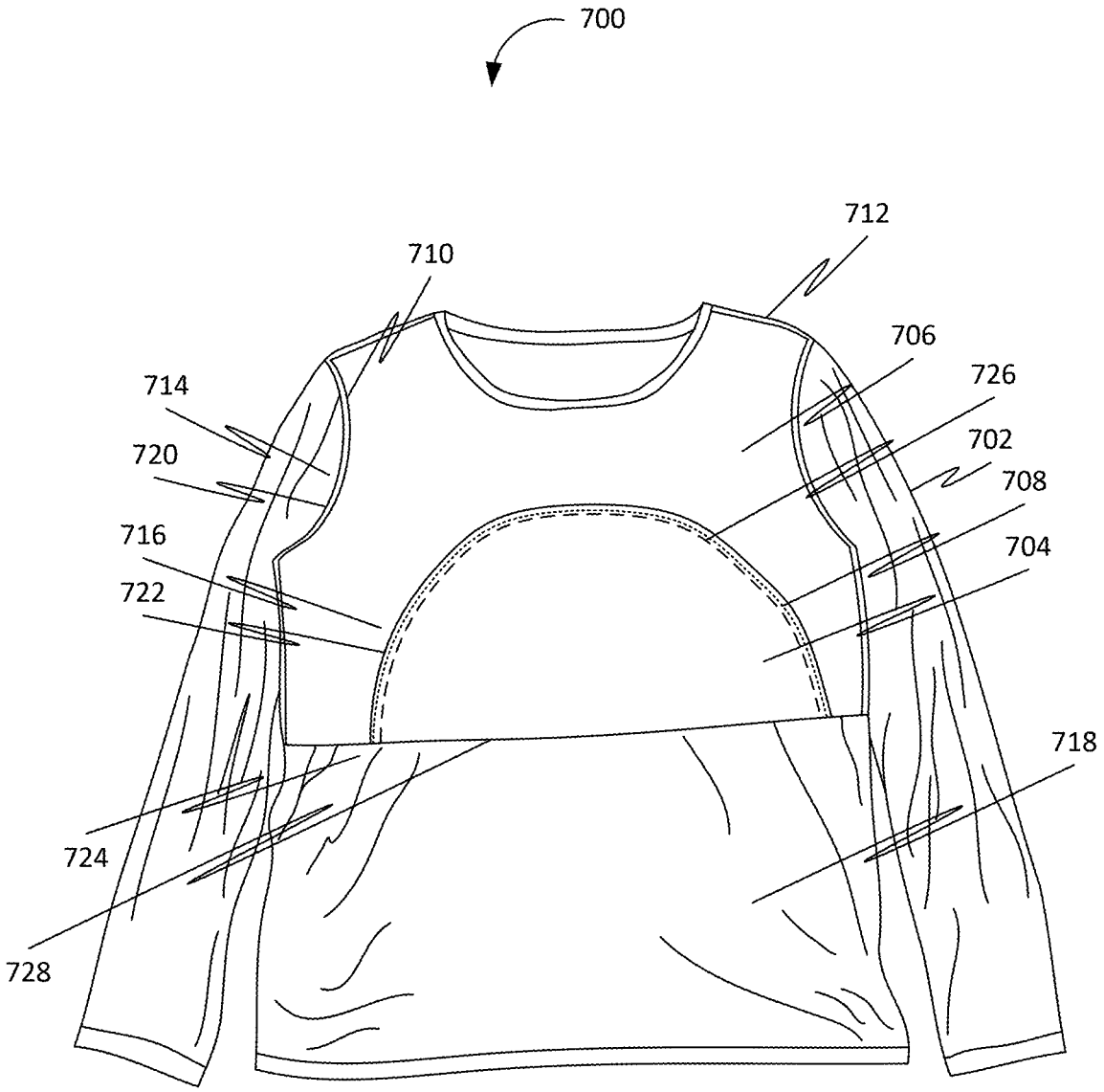
FIG. 6 is a front view of a padded garment 700, shown inside-out, in accordance with some embodiments.

FIG. 6 is a front view of a padded garment 700, shown inside-out, in accordance with some embodiments. Accordingly, the padded garment 700 may include a garment 702, a first fabric layer 704, a second fabric layer 706, a first interstitial binding 708, and a second interstitial binding 710. Further, the garment 702 may include a shirt, a sweater, a sweatshirt, an upper garment, a jacket, etc.

Further, the garment 702 may include a torso portion 712. Further, the torso portion 712 may be shaped to cover a torso of a body of a user wearing the padded garment 700. Further, the user may be a wearer of the padded garment 700. Further, the user may include an individual, etc. Further, the first fabric layer 704 may be disposed in an interior of the garment 702. Further, the second fabric layer 706 may be disposed in the interior of the garment 702. Further, the first interstitial binding 708 may include a first stitching. Further, the second interstitial binding 710 may include a second stitching. Further, at least one first portion 720 of a second fabric layer periphery 714 of the second fabric layer 706 may be engaged to an inner surface 718 of the garment 702 using the second interstitial binding 710. Further, at least one first portion 722 of a first fabric layer periphery 716 of the first fabric layer 704 may be engaged to at least a portion 726 of at least one second portion 724 of the second fabric layer periphery 714 of the second fabric layer 706 using the first interstitial binding 708. Further, in an embodiment, the at least one first portion 720 of the second fabric layer periphery 714 of the second fabric layer 706 may be peripherally engaged to the inner surface 718 of the garment 702 using the second interstitial binding 710. Further, the at least one first portion 722 of the first fabric layer periphery 716 of the first fabric layer 704 may be peripherally engaged to at least the portion 726 of the at least one second portion 724 of the second fabric layer periphery 714 of the second fabric layer 706 using the first interstitial binding 708. Further, in an embodiment, at least one of the engaging and the peripherally engaging may include attaching, securing, fastening, affixing, etc. Further, in an embodiment, at least one of the first interstitial binding 708 and the second interstitial binding 710 may include a mechanically fastening, a thermal welding, an adhesively attaching, etc. Further, the first stitching and the second stitching may be based on a plurality of first stitches and a plurality of second stitches respectively. Further, the mechanically fastening may be based on a mechanical fastener, the thermal welding may be based on a thermal welder, the adhesively attaching may be based on at least one adhesive, etc.

Further, in some embodiments, the at least one second portion 724 of the second fabric layer periphery 714 of the second fabric layer 706 may be unengaged from the garment 702. Further, the unengaged may include unsecured, detached, separated, etc.

Further, in an embodiment, at least one second portion 728 of the first fabric layer periphery 716 may be unengaged from at least the portion 726 of the at least one second portion 724 of the second fabric layer periphery 714, and the garment 702. Further, the at least one second portion 724 of the second fabric layer periphery 714 and the at least one second portion 728 of the first fabric layer periphery 716 may be free from the garment 702.

Figure 7:
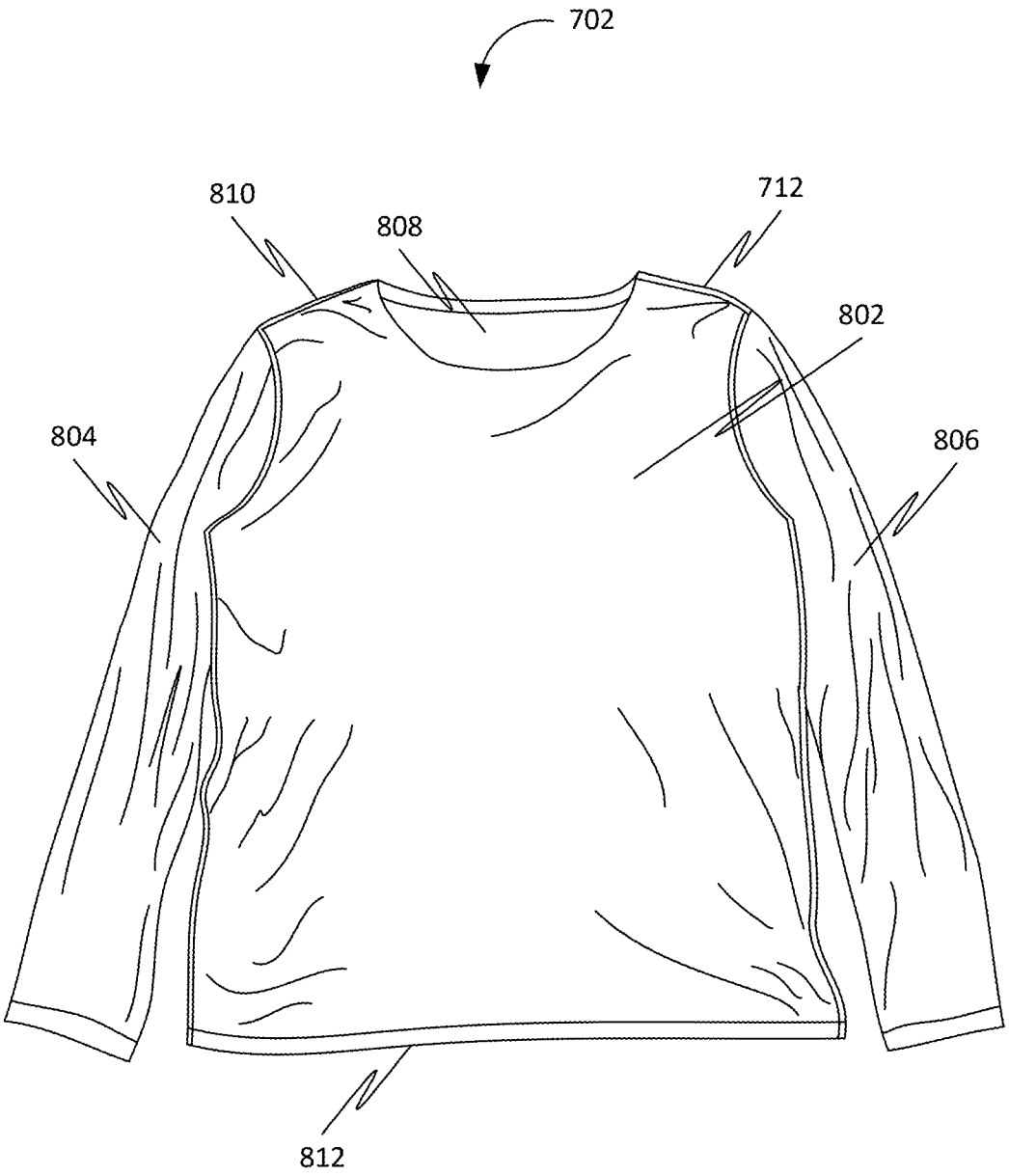
FIG. 7 is a front view of the garment 702 of the padded garment 700, shown inside-out, in accordance with some embodiments.

Further, in some embodiments, the torso portion 712 may include a front torso portion 802 and at least one torso portion 804-808, as shown in FIG. 7. Further, the at least one torso portion 804-808 may include a back torso portion, at least one sleeve portion, at least one neck portion, at least one shoulder portion, etc. Further, the front torso portion 802 extends from a top end 810, as shown in FIG. 7, of the front torso portion 802 and a bottom end 812, as shown in FIG. 7, of the front torso portion 802. Further, the second fabric layer 706 extends from the top end 810 of the first torso portion. Further, the second fabric layer 706 may be configured to extend about a first portion of a chest region of a body of a user wearing the padded garment 700. Further, the first portion of the chest region of may include an upper chest region of the body.

Further, in an embodiment, the first fabric layer 704 extends from at least the portion 726 of the at least one second portion 724 of the second fabric layer periphery 714 of the second fabric layer 706. Further, the first fabric layer 704 may be configured to extend about a second portion of the chest region of the body of the user wearing the padded garment 700. Further, the chest region may include the first portion and the second portion. Further, the second portion of the chest region may include a lower chest region.

Figure 8:
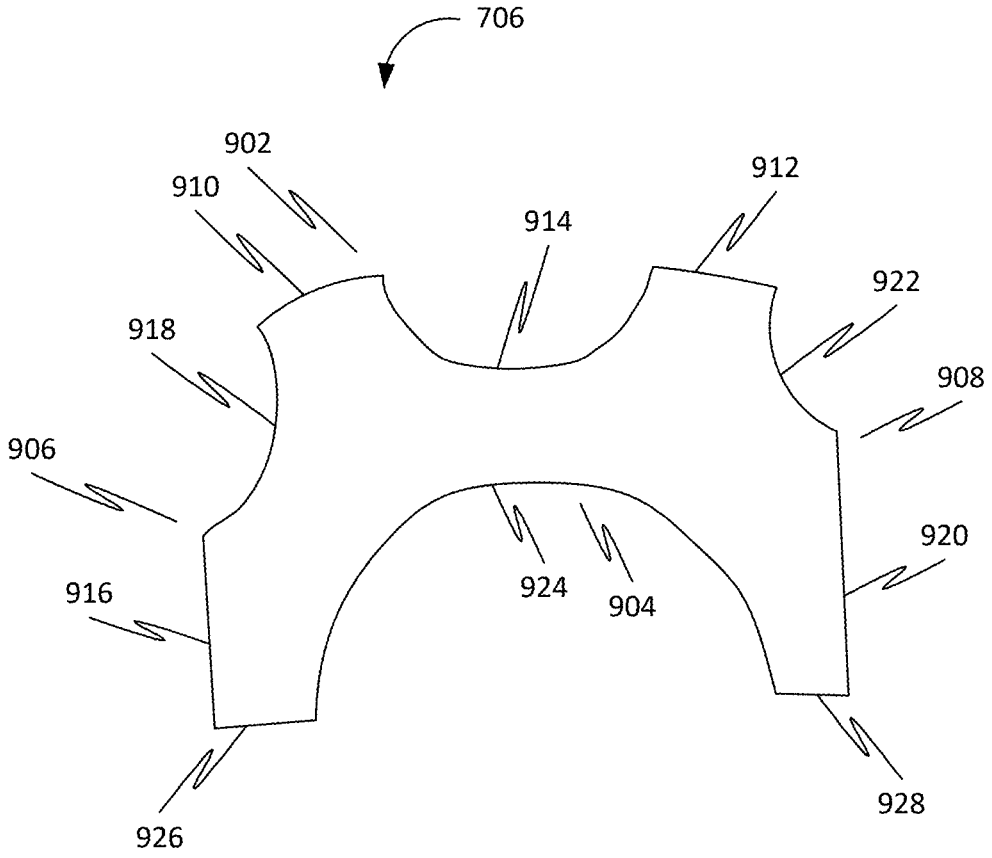
FIG. 8 is a front view of the second fabric layer 706 of the padded garment 700, in accordance with some embodiments.

Further, in some embodiments, the second fabric layer 706 may include a top edge 902, a bottom edge 904, a first side edge 906, and a second side edge 908, as shown in FIG. 8. Further, the top edge 902 may include a first top edge portion 910, a second top edge portion 912, and a neck edge portion 914 extending between the first top edge portion 910 and the second top edge portion 912, as shown in FIG. 8. Further, the first side edge 906 may include a first side edge portion 916 and a first armhole edge portion 918 extending between the first top edge portion 910 and the first side edge portion 916, as shown in FIG. 8. Further, the second side edge 908 may include a second side edge portion 920 and a second armhole edge portion 922 extending between the second top edge portion 912 and the second side edge portion 920 as shown in FIG. 8. Further, the bottom edge 904 may include a layer attaching edge portion 924 as shown in FIG. 8. Further, the top edge 902, the bottom edge 904, the first side edge 906, and the second side edge 908 define the second fabric layer periphery 714.

Figure 9:
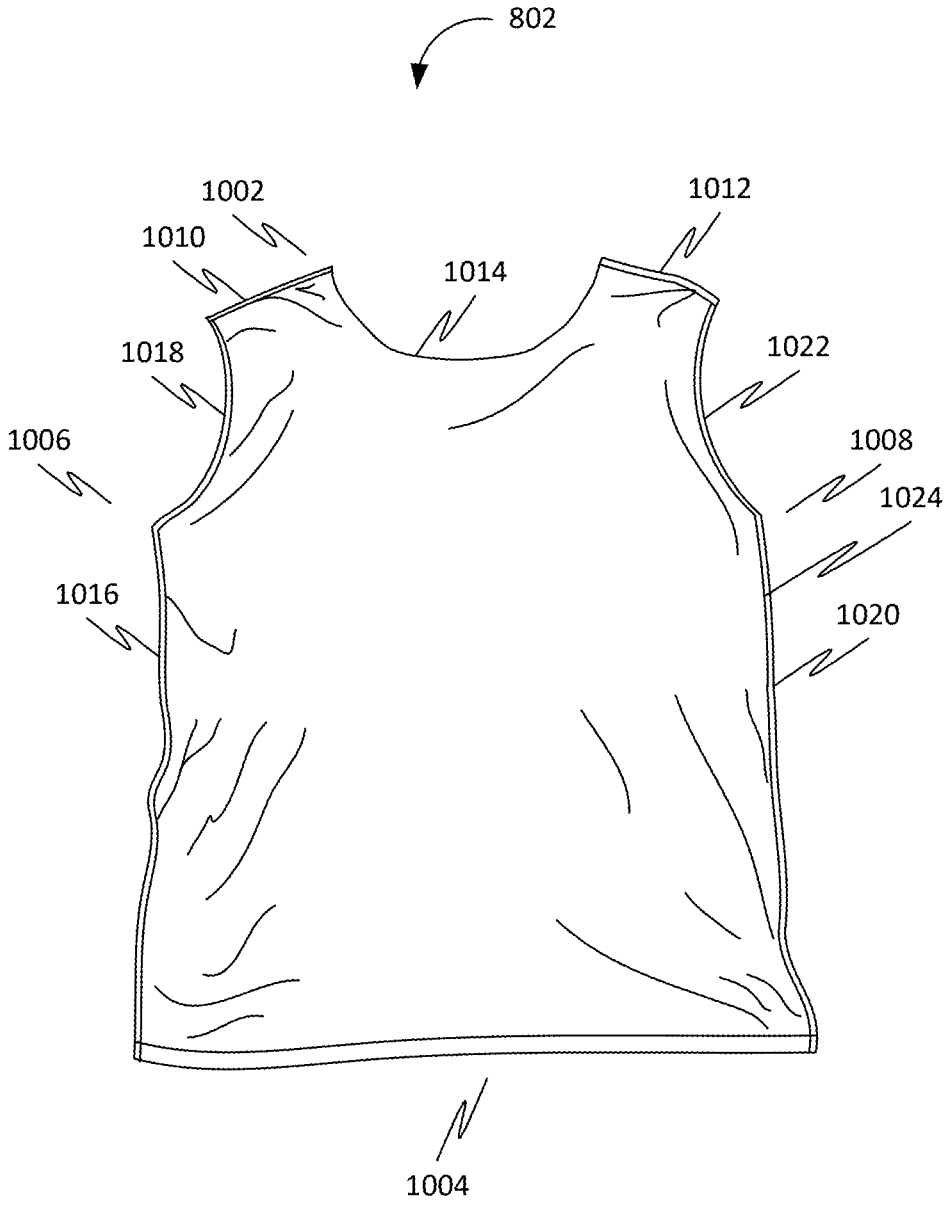
FIG. 9 is a rear view of the front torso portion 802 of the torso portion 712, in accordance with some embodiments.

Further, in an embodiment, the torso portion 712 may include the front torso portion 802 and the at least one torso portion 804-808. Further, the front torso portion 802 may include a top torso edge 1002, a bottom torso edge 1004, a first side torso edge 1006, and a second side torso edge 1008 as shown in FIG. 9. Further, the top torso edge 1002 may include a first top torso edge portion 1010, a second top torso edge portion 1012, and a neck torso edge portion 1014 extending between the first top torso edge portion 1010 and the second top torso edge portion 1012, as shown in FIG. 9. Further, the first side torso edge 1006 may include a first side torso edge portion 1016 and a first armhole torso edge portion 1018 extending between the first top torso edge portion 1010 and the first side torso edge portion 1016, as shown in FIG. 9. Further, the second side torso edge 1008 may include a second side torso edge portion 1020 and a second armhole torso edge portion 1022 extending between the second top torso edge portion 1012 and the second side torso edge portion 1020, as shown in FIG. 9. Further, the padded garment 700 may include a torso binding 1024, as shown in FIG. 9, comprising a torso stitching. Further, the front torso portion 802 may be engaged to the at least one torso portion 804-808 using the torso binding 1024. Further, the second interstitial binding 710 may be aligned with the torso binding 1024. Further, the torso binding 1024 may be an interstitial binding. Further, the torso binding 1024 may include a mechanically fastening, a thermal welding, an adhesively attaching, etc. Further, the aligning of the second interstitial binding 710 may align with the torso binding 1024 masks the second interstitial binding 710. Further, the torso binding 1024 may include an existing stitching on the garment 702.

Further, in an embodiment, the at least one first portion 720 of the second fabric layer periphery 714 may include the top edge 902, the first side edge 906, and the second side edge 908. Further, the at least one second portion 724 of the second fabric layer periphery 714 may include the bottom edge 904. Further, the top edge 902 may be engaged to the top torso edge 1002, the first side edge 906 may be engaged to the first side torso edge 1006, and the second side edge 908 may be engaged to the second side torso edge 1008, respectively, using the second interstitial binding 710.

Figure 10:
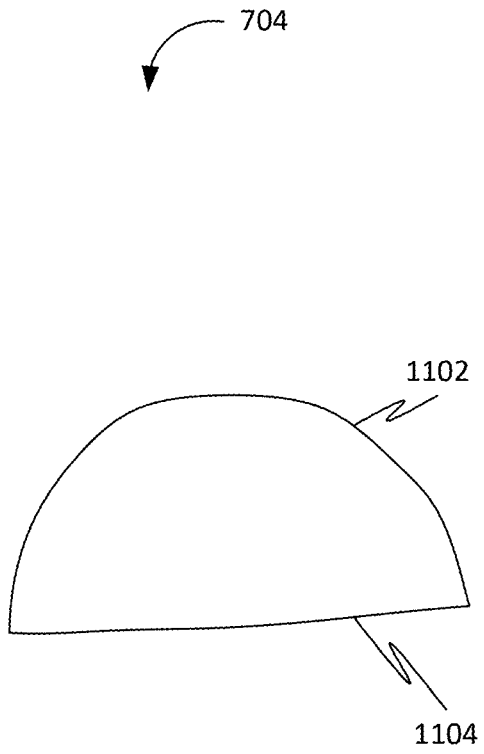
FIG. 10 is a front view of the first fabric layer 704 of the padded garment 700, in accordance with some embodiments.

Further, in an embodiment, the layer attaching edge portion 924 may be inwardly curved. Further, the layer attaching edge portion 924 may be shaped in a semi-elliptical shape, a semi-circular shaped, etc. Further, the first fabric layer 704 may include an upper edge 1102 and a lower edge 1104, as shown in FIG. 10. Further, the upper edge 1102 may be outwardly curved complementing the layer attaching edge portion 924. Further, the upper edger 1102 may be shaped in a semi-elliptical shape, a semi-circular shaped, etc. Further, at least the portion 726 of the at least one second portion 724 of the second fabric layer periphery 714 may include the layer attaching edge portion 924. Further, the engaging of the at least one first portion 722 of the first fabric layer periphery 716 of the first fabric layer 704 to at least the portion 726 of the at least one second portion 724 of the second fabric layer periphery 714 of the second fabric layer 706 may include engaging the upper edge 1102 of the first fabric layer 704 to the layer attaching edge portion 924 of the second fabric layer 706 using the first interstitial binding 708.

Further, in an embodiment, the lower edge 1104 may be a free edge. Further, each of the upper edge 1102 and the layer attaching edge portion 924 may be an engaged edge.

Further, in an embodiment, the bottom edge 904 may include a first bottom edge portion 926 and a second bottom edge portion 928 as shown in FIG. 8. Further, the layer attaching edge portion 924 extends between the first bottom edge portion 926 and the second bottom edge portion 928. Further, each of the first bottom edge portion 926 and the second bottom edge portion 928 may be a free edge.

Figure 11:
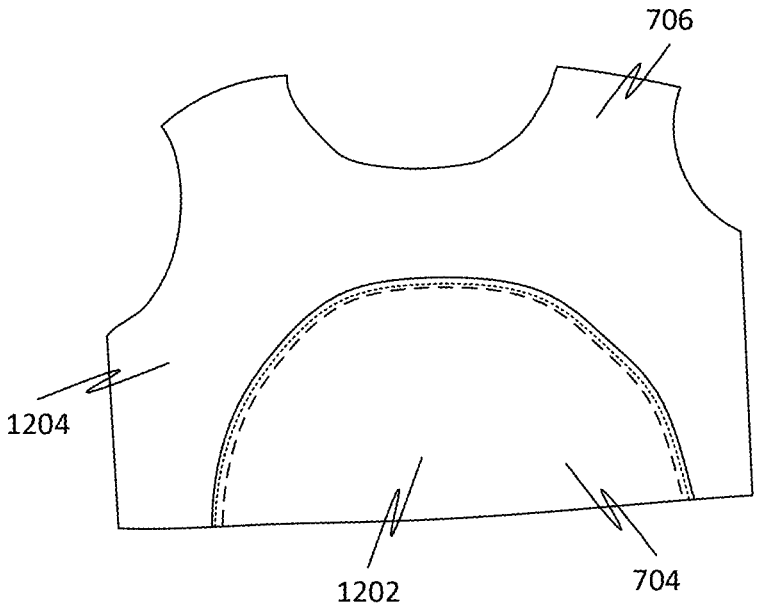
FIG. 11 is a rear view of the first fabric layer 704 and the second fabric layer 706 of the padded garment 700, in accordance with some embodiments.
Figure 12:
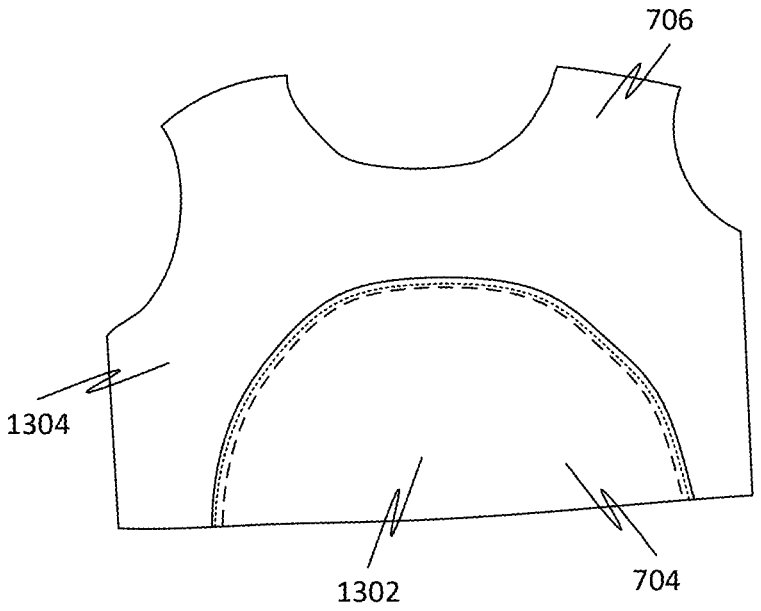
FIG. 12 is a rear view of the first fabric layer 704 and the second fabric layer 706 of the padded garment 700, in accordance with some embodiments.

Further, in some embodiments, each of the first fabric layer 704 and the second fabric layer 706 may include an inner layer surface (1202 and 1204), as shown in FIG. 11, and an outer layer surface (1302 and 1304), as shown in FIG. 12, opposing the inner layer surface (1202 and 1204). Further, the inner layer surface (1202 and 1204) faces a skin of a body of a user wearing the padded garment 700. Further, the outer layer surface (1302 and 1304) faces the inner surface 718 of the garment 702.

Further, in an embodiment, the inner layer surface (1202 and 1204) may be softer than the outer layer surface (1302 and 1304). Further, the inner layer surface (1202 and 1204) may include an inner surface feature and the outer layer surface (1302 and 1304) may include an outer surface feature. Further, the inner surface feature may be soft. Further, the outer surface feature may be coarse.

Further, in some embodiments, each of the first fabric layer 704 and the second fabric layer 706 may be comprised of at least one layer material. Further, the garment 702 may be comprised of at least one garment material. Further, the at least one layer material may be softer than the at least one garment material. Further, the at least one layer material may include silk, soft cotton (pima cotton), flannel, microfiber, etc. Further, the at least one garment material may include coarse cotton, wool, nylon, polyester, rayon, etc.

Further, in some embodiments, each of the first fabric layer 704 and the second fabric layer 706 may be comprised of at least one layer material. Further, the garment 702 may be comprised of at least one garment material. Further, the at least one layer material may be opaquer than the at least one garment material. Further, the at least one layer material may include cotton, silk, velvet, etc. Further, the at least one garment material may include chiffon, organza, tulle, nylon, nylon-cotton blend, etc.

Further, in some embodiments, each of the first fabric layer 704 and the second fabric layer 706 may be comprised of at least one layer material. Further, the garment 702 may be comprised of at least one garment material. Further, the at least one layer material may be firmer than the at least one garment material. Further, the at least one layer material may include flannel, cotton, linen, velvet, cashmere, etc. Further, the at least one garment material may include silk, nylon-cotton bled, jersey, chiffon, etc.

Further, in some embodiments, the first fabric layer 704 may be comprised of at least one first material. Further, the second fabric layer 706 may be comprised of at least one second material. Further, the at least one first material may be softer than the at least one second material. Further, the at least one first material may include silk, soft cotton (pima cotton), flannel, microfiber, etc. Further, the at least one second material may include coarse cotton, nylon, polyester, rayon, etc.

Further, in some embodiments, a garment thickness of the garment 702 may be thinner than a layer thickness of at least one of the first fabric layer 704 and the second fabric layer 706. Further, the garment thickness of the garment 702 may allow a degree of see-throughness (such a transparency) through the garment 702. Further, the layer thickness of at least one of the first fabric layer 704 and the second fabric layer 706 entirely prevents a see-throughness through at least one of the first fabric layer 704 and the second fabric layer 706.

Further, in some embodiments, at least one of the first fabric layer 704 and the second fabric layer 706 may be elastically stretchable. Further, at least one of the first fabric layer 704 and the second fabric layer 706 may be comprised of at least one fiber. Further, the at least one fiber may be comprised of at least one material. Further, the at least one material may be elastically stretchable. Further, the at least one material may include rubber, neoprene, elastomeric polymer, elastic polymer, etc.

Further, in some embodiments, an elastic stretchability of the garment 702 may be less than at least one of the first fabric layer 704 and the second fabric layer 706. Further, the elastic stretchability may be defined as an ability to stretch from an original shape and return to the original shape when an applied stretching force is removed.

FIG. 7 is a front view of the garment 702 of the padded garment 700, shown inside-out, in accordance with some embodiments.

FIG. 8 is a front view of the second fabric layer 706 of the padded garment 700, in accordance with some embodiments.

FIG. 9 is a rear view of the front torso portion 802 of the torso portion 712, in accordance with some embodiments.

FIG. 10 is a front view of the first fabric layer 704 of the padded garment 700, in accordance with some embodiments.

FIG. 11 is a rear view of the first fabric layer 704 and the second fabric layer 706 of the padded garment 700, in accordance with some embodiments.

FIG. 12 is a rear view of the first fabric layer 704 and the second fabric layer 706 of the padded garment 700, in accordance with some embodiments.

Figure 13:
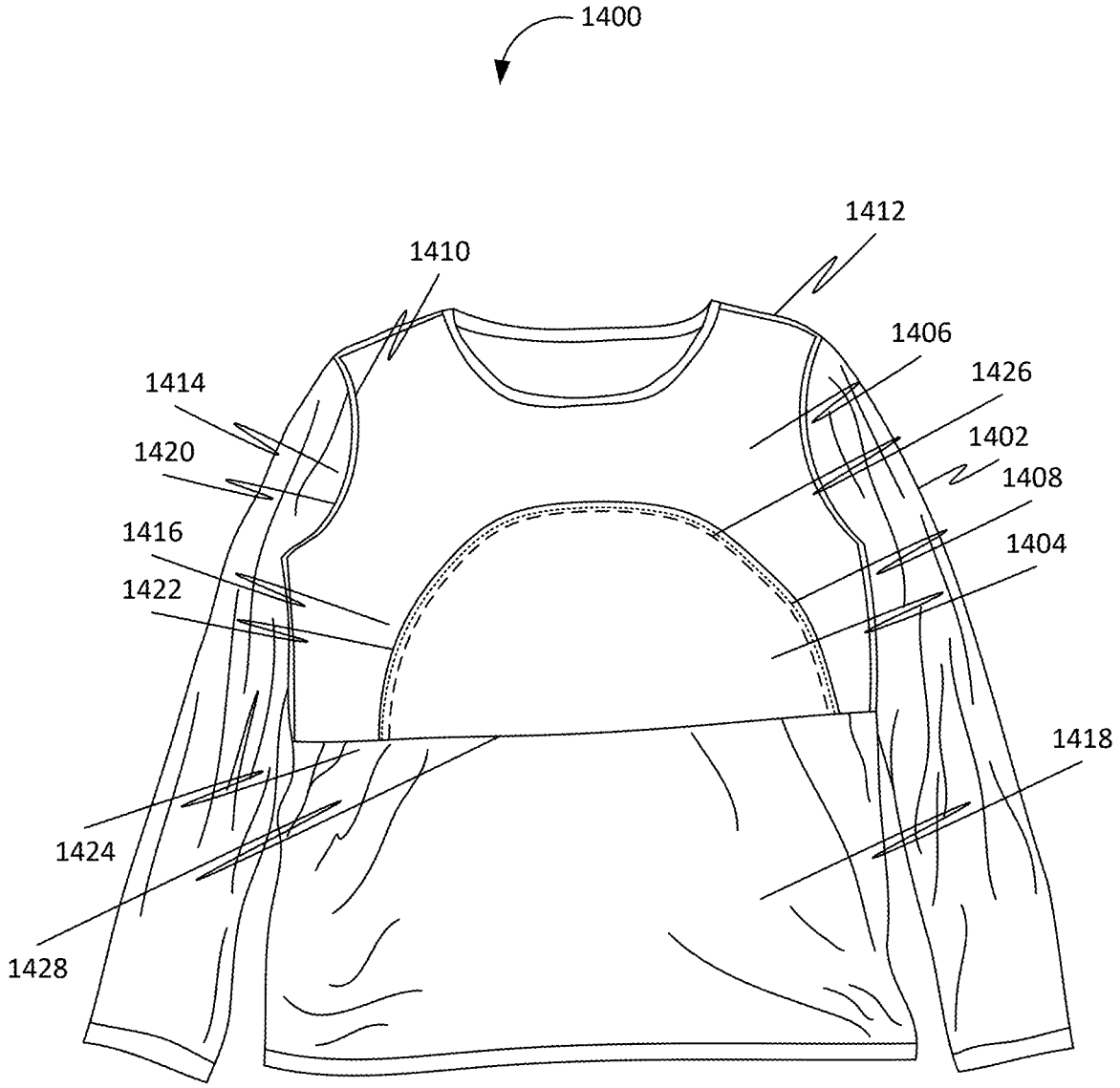
FIG. 13 is a front view of a padded garment 1400, shown inside-out, in accordance with some embodiments.

FIG. 13 is a front view of a padded garment 1400, shown inside-out, in accordance with some embodiments. Accordingly, the padded garment 1400 may include a garment 1402, a first fabric layer 1404, a second fabric layer 1406, a first interstitial binding 1408, and a second interstitial binding 1410.

Further, the garment 1402 may include a torso portion 1412. Further, the first fabric layer 1404 may be disposed in an interior of the garment 1402. Further, the second fabric layer 1406 may be disposed in the interior of the garment 1402. Further, the first interstitial binding 1408 may include a first stitching. Further, the second interstitial binding 1410 may include a second stitching. Further, at least one first portion 1420 of a second fabric layer periphery 1414 of the second fabric layer 1406 may be engaged to an inner surface 1418 of the garment 1402 using the second interstitial binding 1410. Further, at least one first portion 1422 of a first fabric layer periphery 1416 of the first fabric layer 1404 may be engaged to at least a portion 1426 of at least one second portion 1424 of the second fabric layer periphery 1414 of the second fabric layer 1406 using the first interstitial binding 1408. Further, the at least one second portion 1424 of the second fabric layer periphery 1414 of the second fabric layer 1406 may be unengaged from the garment 1402. Further, at least one second portion 1428 of the first fabric layer periphery 1416 may be unengaged from at least the portion 1426 of the at least one second portion 1424 of the second fabric layer periphery 1414, and the garment 1402. Further, the at least one second portion 1424 of the second fabric layer periphery 1414 and the at least one second portion 1428 of the first fabric layer periphery 1416 may be free from the garment 1402.

Figure 14:
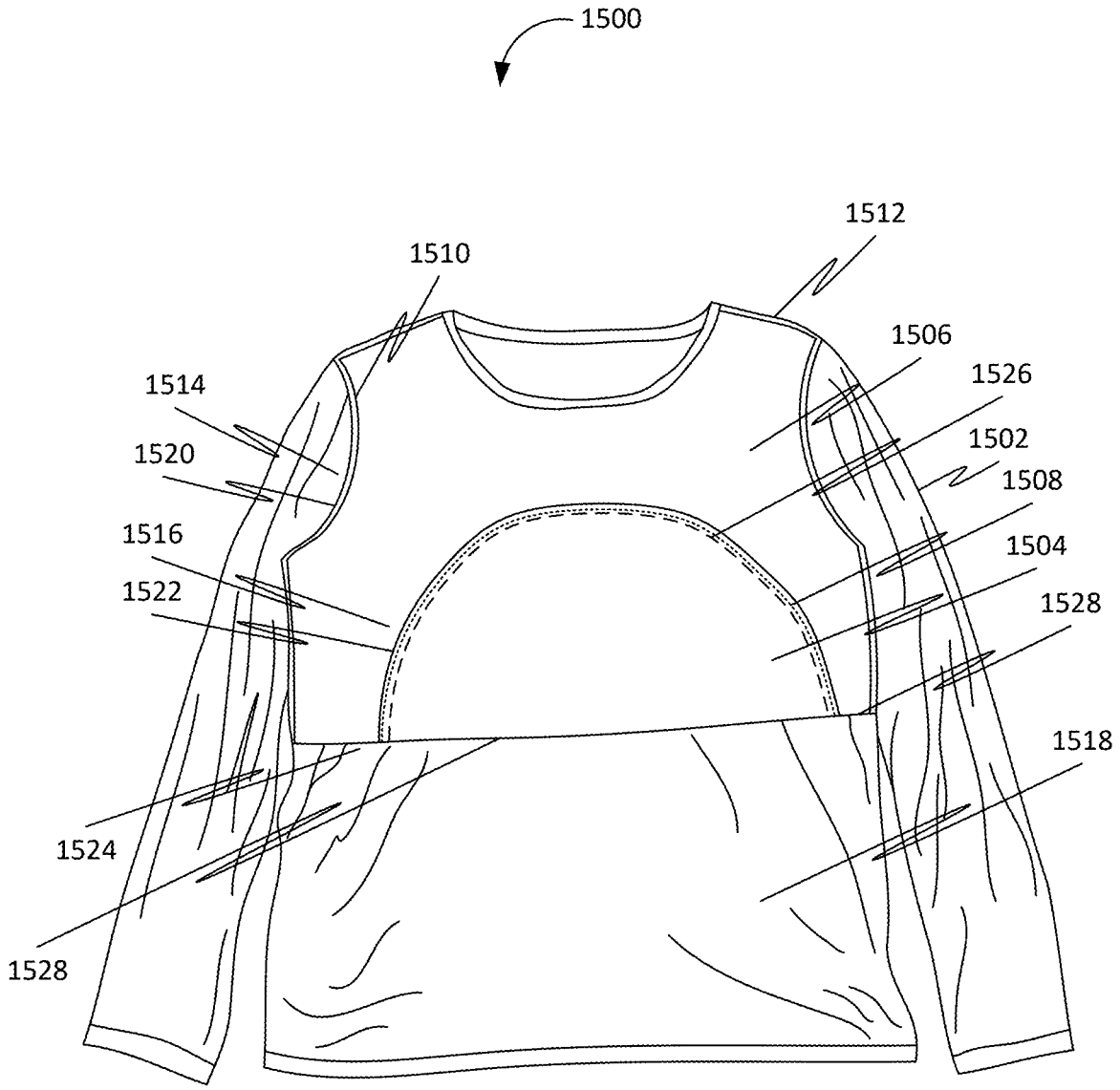
FIG. 14 is a front view of a padded garment 1500, shown inside-out, in accordance with some embodiments.

FIG. 14 is a front view of a padded garment 1500, shown inside-out, in accordance with some embodiments. Accordingly, the padded garment 1500 may include a garment 1502, a first fabric layer 1504, a second fabric layer 1506, a first interstitial binding 1508, and a second interstitial binding 1510.

Further, the garment 1502 may include a torso portion 1512. Further, the first fabric layer 1504 may be disposed in an interior of the garment 1502. Further, the second fabric layer 1506 may be disposed in the interior of the garment 1502. Further, the first interstitial binding 1508 may include a first stitching. Further, the second interstitial binding 1510 may include a second stitching. Further, at least one first portion 1520 of a second fabric layer periphery 1514 of the second fabric layer 1506 may be engaged to an inner surface 1518 of the garment 1502 using the second interstitial binding 1510. Further, at least one first portion 1522 of a first fabric layer periphery 1516 of the first fabric layer 1504 may be engaged to at least a portion 1526 of at least one second portion 1524 of the second fabric layer periphery 1514 of the second fabric layer 1506 using the first interstitial binding 1508. Further, the at least one second portion 1524 of the second fabric layer periphery 1514 of the second fabric layer 1506 may be unengaged from the garment 1502. Further, at least one second portion 1528 of the first fabric layer periphery 1516 may be unengaged from at least the portion 1526 of the at least one second portion 1524 of the second fabric layer periphery 1514, and the garment 1502. Further, the at least one second portion 1524 of the second fabric layer periphery 1514 and the at least one second portion 1528 of the first fabric layer periphery 1516 may be free from the garment 1502. Further, the first fabric layer 1504 may be comprised of at least one first material. Further, the second fabric layer 1506 may be comprised of at least one second material. Further, the at least one first material may be softer than the at least one second material.

Although the present disclosure has been explained in relation to its preferred embodiment, it is to be understood that many other possible modifications and variations can be made without departing from the spirit and scope of the disclosure.

What is claimed is:

1. A padded garment comprising:

a garment comprising a torso portion;

a first fabric layer disposed in an interior of the garment;

a second fabric layer disposed in the interior of the garment;

a first interstitial binding comprising a first stitching;

a second interstitial binding comprising a second stitching;

at least one first portion of a second fabric layer periphery of the second fabric layer being engaged to an inner surface of the garment using the second interstitial binding; and at least one first portion of a first fabric layer periphery of the first fabric layer being engaged to at least a portion of at least one second portion of the second fabric layer periphery of the second fabric layer using the first interstitial binding;

wherein the second fabric layer comprises a top edge, a bottom edge, a first side edge, and a second side edge, wherein the top edge comprises a first top edge portion, a second top edge portion, and a neck edge portion extending between the first top edge portion and the second top edge portion, wherein the first side edge comprises a first side edge portion and a first armhole edge portion extending between the first top edge portion and the first side edge portion, wherein the second side edge comprises a second side edge portion and a second armhole edge portion extending between the second top edge portion and the second side edge portion, wherein the bottom edge comprises a layer attaching edge portion, wherein the top edge, the bottom edge, the first side edge, and the second side edge defines the second fabric layer periphery;

wherein the torso portion comprises a front torso portion and at least one torso portion, wherein the front torso portion comprises a top torso edge, a bottom torso edge, a first side torso edge, and a second side torso edge, wherein the top torso edge comprises a first top torso edge portion, a second top torso edge portion, and a neck torso edge portion extending between the first top torso edge portion and the second top torso edge portion, wherein the first side torso edge comprises a first side torso edge portion and a first armhole torso edge portion extending between the first top torso edge portion and the first side torso edge portion, wherein the second side torso edge comprises a second side torso edge portion and a second armhole torso edge portion extending between the second top torso edge portion and the second side torso edge portion, wherein the padded garment further comprises a torso binding comprising a torso stitching, wherein the front torso portion being engaged to the at least one torso portion using the torso binding, wherein the second interstitial binding is aligned with the torso binding; and wherein the at least one first portion of the second fabric layer periphery comprises the top edge, the first side edge, and the second side edge, wherein the at least one second portion of the second fabric layer periphery comprises the bottom edge, wherein the top edge is engaged to the top torso edge, the first side edge is engaged to the first side torso edge, and the second side edge is engaged to the second side torso edge, respectively, using the second interstitial binding.

2. The padded garment of claim 1, wherein the at least one second portion of the second fabric layer periphery of the second fabric layer is unengaged from the garment.

3. The padded garment of claim 2, wherein at least one second portion of the first fabric layer periphery is unengaged from at least the portion of the at least one second portion of the second fabric layer periphery, and the garment, wherein the at least one second portion of the second fabric layer periphery and the at least one second portion of the first fabric layer periphery is free from the garment.

4. The padded garment of claim 1, wherein the torso portion comprises a front torso portion and at least one torso portion, wherein the front torso portion extends from a top end of the front torso portion and a bottom end of the front torso portion, wherein the second fabric layer extends from the top end of the first torso portion, wherein the second fabric layer is configured to extend about a first portion of a chest region of a body of a user wearing the padded garment.

5. The padded garment of claim 4, wherein the first fabric layer extends from at least the portion of the at least one second portion of the second fabric layer periphery of the second fabric layer, wherein the first fabric layer is configured to extend about a second portion of the chest region of the body of the user wearing the padded garment, wherein the chest region comprises the first portion and the second portion.

6. The padded garment of claim 1, wherein the layer attaching edge portion is inwardly curved, wherein the first fabric layer comprises an upper edge and a lower edge, wherein the upper edge is outwardly curved complementing the layer attaching edge portion, wherein at least the portion of the at least one second portion of the second fabric layer periphery comprises the layer attaching edge portion, wherein the engaging of the at least one first portion of the first fabric layer periphery of the first fabric layer to at least the portion of the at least one second portion of the second fabric layer periphery of the second fabric layer comprises engaging the upper edge of the first fabric layer to the layer attaching edge portion of the second fabric layer using the first interstitial binding.

7. The padded garment of claim 6, wherein the lower edge is a free edge, wherein each of the upper edge and the layer attaching edge portion is an engaged edge.

8. The padded garment of claim 7, wherein the bottom edge comprises a first bottom edge portion and a second bottom edge portion, wherein the layer attaching edge portion extends between the first bottom edge portion and the second bottom edge portion, wherein each of the first bottom edge portion and the second bottom edge portion is a free edge.

9. The padded garment of claim 1, wherein each of the first fabric layer and the second fabric layer comprises an inner layer surface and an outer layer surface opposing the inner layer surface, wherein the inner layer surface faces a skin of a body of a user wearing the padded garment, wherein the outer layer surface faces the inner surface of the garment.

10. The padded garment of claim 9, wherein the inner layer surface is softer than the outer layer surface.

11. The padded garment of claim 1, wherein each of the first fabric layer and the second fabric layer is comprised of at least one layer material, wherein the garment is comprised of at least one garment material, wherein the at least one layer material is softer than the at least one garment material.

12. The padded garment of claim 1, wherein the first fabric layer is comprised of at least one first material, wherein the second fabric layer is comprised of at least one second material, wherein the at least one first material is softer than the at least one second material.

13. The padded garment of claim 1, wherein a garment thickness of the garment is thinner than a layer thickness of at least one of the first fabric layer and the second fabric layer.

14. The padded garment of claim 1, wherein at least one of the first fabric layer and the second fabric layer is elastically stretchable.

15. The padded garment of claim 1, wherein an elastic stretchability of the garment is less than at least one of the first fabric layer and the second fabric layer.

16. A padded garment comprising:

a garment comprising a torso portion;

a first fabric layer disposed in an interior of the garment;

a second fabric layer disposed in the interior of the garment;

a first interstitial binding comprising a first stitching;

a second interstitial binding comprising a second stitching;

at least one first portion of a second fabric layer periphery of the second fabric layer being engaged to an inner surface of the garment using the second interstitial binding; and at least one first portion of a first fabric layer periphery of the first fabric layer being engaged to at least a portion of at least one second portion of the second fabric layer periphery of the second fabric layer using the first interstitial binding, wherein the at least one second portion of the second fabric layer periphery of the second fabric layer is unengaged from the garment, wherein at least one second portion of the first fabric layer periphery is unengaged from at least the portion of the at least one second portion of the second fabric layer periphery, and the garment, wherein the at least one second portion of the second fabric layer periphery and the at least one second portion of the first fabric layer periphery is free from the garment;

wherein the second fabric layer comprises a top edge, a bottom edge, a first side edge, and a second side edge, wherein the top edge comprises a first top edge portion, a second top edge portion, and a neck edge portion extending between the first top edge portion and the second top edge portion, wherein the first side edge comprises a first side edge portion and a first armhole edge portion extending between the first top edge portion and the first side edge portion, wherein the second side edge comprises a second side edge portion and a second armhole edge portion extending between the second top edge portion and the second side edge portion, wherein the bottom edge comprises a layer attaching edge portion, wherein the top edge, the bottom edge, the first side edge, and the second side edge defines the second fabric layer periphery;

wherein the torso portion comprises a front torso portion and at least one torso portion, wherein the front torso portion comprises a top torso edge, a bottom torso edge, a first side torso edge, and a second side torso edge, wherein the top torso edge comprises a first top torso edge portion, a second top torso edge portion, and a neck torso edge portion extending between the first top torso edge portion and the second top torso edge portion, wherein the first side torso edge comprises a first side torso edge portion and a first armhole torso edge portion extending between the first top torso edge portion and the first side torso edge portion, wherein the second side torso edge comprises a second side torso edge portion and a second armhole torso edge portion extending between the second top torso edge portion and the second side torso edge portion, wherein the padded garment further comprises a torso binding comprising a torso stitching, wherein the front torso portion being engaged to the at least one torso portion using the torso binding, wherein the second interstitial binding is aligned with the torso binding; and wherein the at least one first portion of the second fabric layer periphery comprises the top edge, the first side edge, and the second side edge, wherein the at least one second portion of the second fabric layer periphery comprises the bottom edge, wherein the top edge is engaged to the top torso edge, the first side edge is engaged to the first side torso edge, and the second side edge is engaged to the second side torso edge, respectively, using the second interstitial binding.

17. A padded garment comprising:

a garment comprising a torso portion;

a first fabric layer disposed in an interior of the garment;

a second fabric layer disposed in the interior of the garment;

a first interstitial binding comprising a first stitching;

a second interstitial binding comprising a second stitching;

at least one first portion of a second fabric layer periphery of the second fabric layer being engaged to an inner surface of the garment using the second interstitial binding; and at least one first portion of a first fabric layer periphery of the first fabric layer being engaged to at least a portion of at least one second portion of the second fabric layer periphery of the second fabric layer using the first interstitial binding, wherein the at least one second portion of the second fabric layer periphery of the second fabric layer is unengaged from the garment, wherein at least one second portion of the first fabric layer periphery is unengaged from at least the portion of the at least one second portion of the second fabric layer periphery, and the garment, wherein the at least one second portion of the second fabric layer periphery and the at least one second portion of the first fabric layer periphery is free from the garment, wherein the first fabric layer is comprised of at least one first material, wherein the second fabric layer is comprised of at least one second material, wherein the at least one first material is softer than the at least one second material;

wherein the second fabric layer comprises a top edge, a bottom edge, a first side edge, and a second side edge, wherein the top edge comprises a first top edge portion, a second top edge portion, and a neck edge portion extending between the first top edge portion and the second top edge portion, wherein the first side edge comprises a first side edge portion and a first armhole edge portion extending between the first top edge portion and the first side edge portion, wherein the second side edge comprises a second side edge portion and a second armhole edge portion extending between the second top edge portion and the second side edge portion, wherein the bottom edge comprises a layer attaching edge portion, wherein the top edge, the bottom edge, the first side edge, and the second side edge defines the second fabric layer periphery;

wherein the torso portion comprises a front torso portion and at least one torso portion, wherein the front torso portion comprises a top torso edge, a bottom torso edge, a first side torso edge, and a second side torso edge, wherein the top torso edge comprises a first top torso edge portion, a second top torso edge portion, and a neck torso edge portion extending between the first top torso edge portion and the second top torso edge portion, wherein the first side torso edge comprises a first side torso edge portion and a first armhole torso edge portion extending between the first top torso edge portion and the first side torso edge portion, wherein the second side torso edge comprises a second side torso edge portion and a second armhole torso edge portion extending between the second top torso edge portion and the second side torso edge portion, wherein the padded garment further comprises a torso binding comprising a torso stitching, wherein the front torso portion being engaged to the at least one torso portion using the torso binding, wherein the second interstitial binding is aligned with the torso binding; and wherein the at least one first portion of the second fabric layer periphery comprises the top edge, the first side edge, and the second side edge, wherein the at least one second portion of the second fabric layer periphery comprises the bottom edge, wherein the top edge is engaged to the top torso edge, the first side edge is engaged to the first side torso edge, and the second side edge is engaged to the second side torso edge, respectively, using the second interstitial binding.

* * * * *